US005727574A

United States Patent [19]

Frye

[11] Patent Number: 5,727,574

[45] Date of Patent: Mar. 17, 1998

[54] METHOD AND APPARATUS OF BRAIDING HAIR

[76] Inventor: Carol E. Frye, 210 National Union Blvd., Little Egg Harbor, N.J. 08087

[21] Appl. No.: 692,775

[22] Filed: Aug. 6, 1996

[51] Int. Cl.[6] ..... A45D 7/00

[52] U.S. Cl. ..... 132/210; 132/275

[58] Field of Search ..... 132/200, 201, 132/210, 273, 275, 222, 248; D28/10, 41, 39, 37; 24/17 B, 482, 302, 301; 63/2, 1.1

[56] References Cited

U.S. PATENT DOCUMENTS

| | | | |
|---|---|---|---|
| 721,197 | 2/1903 | Jordan | 132/246 |
| 1,253,880 | 1/1918 | Pickard | 132/248 |
| 2,481,448 | 9/1949 | Schiller | 132/248 |
| 5,411,040 | 5/1995 | Forrest | 132/210 |
| 5,465,741 | 11/1995 | Dvorak | 132/273 |
| 5,497,795 | 3/1996 | Hibbard | D28/41 |

*Primary Examiner*—Todd E. Manahan
*Assistant Examiner*—E. Robert
*Attorney, Agent, or Firm*—Clifford G. Frayne

[57] ABSTRACT

A method and apparatus for braiding hair in which the apparatus substitutes for the third strand, length or section of hair. The apparatus has a flexible resilient member positioned between two fabric covered elastic members, the hair being passed through one of the elastic members and then braided, utilizing two sections or strands of hair and the flexible resilient member, and once braided, the second elastic member is wrapped around the lower portion of the braid to maintain the braid.

2 Claims, 4 Drawing Sheets

METHOD AND APPARATUS OF BRAIDING HAIR

BACKGROUND OF THE INVENTION

1. Field of the Invention

The present invention relates to a method and apparatus for braiding hair and especially a method and apparatus using a braiding aid which replaces one of the standard sections of hair used in braiding.

2. Description of the Prior Art

Braiding has traditionally been a process of interweaving three or more strands or sections or strips of lengths of hair in a diagonal overlapping pattern in order to style a person's hair by the interweaving of the hair.

In the past, many attempts have been made to aid the individual in the braiding of the hair and, in particular, see U.S. Pat. No. 5,454,385 to George for a substantially rigid apparatus for assisting the individual in braiding hair, and U.S. Pat. No. 721,197 to Jordan for an additional apparatus to aid in the braiding of hair, and finally, U.S. Pat. No. 5,497,795 to Hibbard and the patents named therein, as an additional aid in braiding hair in the French braiding method.

U.S. Pat. No. 5,454,385 to George discloses an elongate apparatus having a plurality of upstanding perpendicular posts disposed between a first end having a comb-like device and a second end having a plurality of posts in a horizontal manner, the elongate device and posts cooperative with respect to the strands of hair to allow the individual to weave two strands of hair about and between the posts in order to accomplish a braid.

U.S. Pat. No. 5,497,795 to Hibbard discloses an apparatus having a plurality of rings which are utilized by the individual together with two strands, sections or lengths of hair to interweave the two strands, lengths or sections of hair in between and through the plurality of rings to accomplish a braid.

U.S. Pat. No. 721,197 to Jordan is referred to as a hair crimper which requires a longitudinal member perpendicular to a lateral member in the same plane, the lateral and longitudinal member having a perpendicular member in a vertical plane perpendicular to the plane of the longitudinal and lateral member. In this configuration, the user manipulates both the lateral and longitudinal member and the vertical perpendicular member to secure two sections or strands of hair into a braid.

Applicant's apparatus and method for braiding hair requires an elastic, resilient, fabric-covered ring preferably of a larger diameter, fashioned to an elastic, resilient, fabric-covered ring preferably of a smaller diameter by means of a flexible, resilient ribbon or fabric member. Applicant's invention requires only two strands of hair with Applicant's apparatus substituting for the third strand of hair. In Applicant's invention, the larger, elastic, resilient fabric-covered ring is positioned over a strand of hair emanating from the rear of the skull of the individual and the strand of hair is divided into two sections with Applicant's apparatus comprising the third section. In this configuration, the individual would commence to braid the hair in the normal fashion as if there were three strands of hair emanating from the rear of the skull, with the exception that Applicant's apparatus substitutes for the third strand of hair.

The length of Applicant's apparatus would vary depending upon the length of the hair of the individual to be braided and, as previously stated, would terminate in a preferably smaller, elastic, resilient fabric-covered ring which would be utilized to bind the terminating end of the braid of hair.

Applicant's apparatus could be made in varying lengths and in varying colors such that the individual could braid hair of varying lengths and also, for aesthetic purposes, color code the braid to the other clothing which the individual was wearing.

OBJECTS OF THE INVENTION

An object of the present invention is to provide for a novel method and apparatus for braiding hair which substitutes for the normal third strand of hair utilized in the normal braiding of hair.

A further object of the present invention is to provide for a novel method and apparatus for braiding hair which is not costly and which allows the individual to color code the braid to the other outerwear which the individual is wearing.

A still further object of the present invention is to provide for a novel method and apparatus for braiding hair which firmly secures the start of the braid to the scalp of the individual and which permits the firmly securing of the termination end of the braid.

A still further object of the present invention is to provide for a novel method and apparatus for braiding hair which allows the individual to braid the hair in the normal fashion without an assisted apparatus and thus not learn a new technique.

SUMMARY OF THE INVENTION

A method and apparatus for braiding hair in which the apparatus substitutes for the third strand, length or section of hair normally utilized in braiding, the apparatus having a first ring of elastic, resilient, fabric-covered material for engagement with the initiation point of the braid next to the scalp, and a second ring of elastic, resilient, fabric-covered material for frictional engagement with the termination of the braid to secure the braid in position, the first ring or tie and the second ring or tie being interconnected by a flexible resilient member, preferably of fabric material.

BRIEF DESCRIPTION OF THE DRAWINGS

These objects and other features and advantages of the present invention will be apparent from the written description and the drawings in which.

DETAILED DESCRIPTION OF THE DRAWINGS

Figures 1, 2, 3:
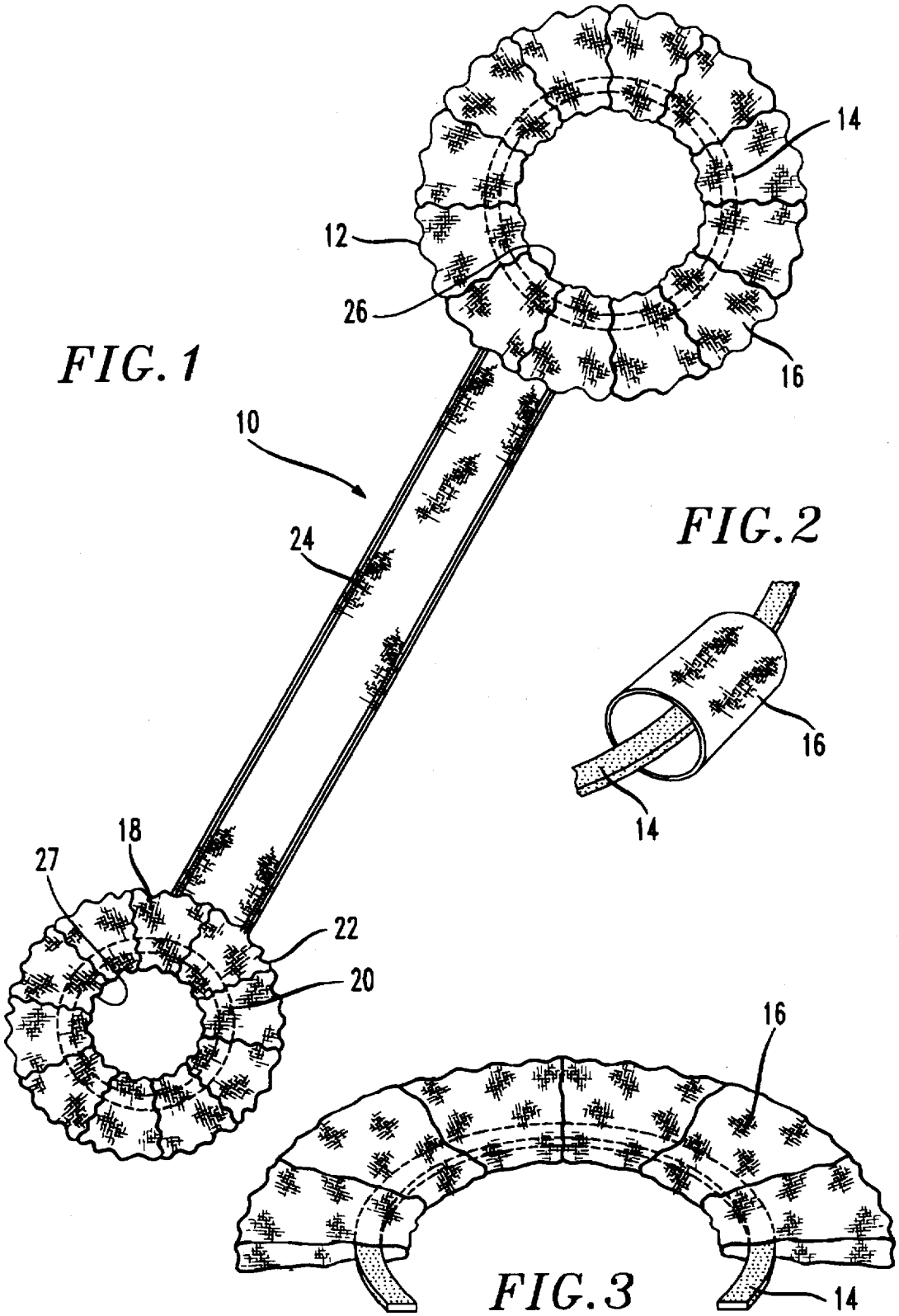
FIG. 1 is a planar view of the braiding apparatus.
FIG. 2 is a partial perspective view of one of the ties of the braiding apparatus.
FIG. 3 is a partial planar view of one of the ties of the braiding apparatus illustrating cooperation between the elastic and cloth sleeve.

FIG. 1 is a planar view of the braiding apparatus 10. Braiding apparatus 10 comprises three interconnecting elements. The first element is an upper tie 12 generally circular in nature comprising a resilient elastic band or fabric 14 which is encapsulated within a sleeve 16. Sleeve 16 is a cloth of natural occurring fiber or a synthetic material, i.e., cotton, wool, linen or satin, rayon, Nylon, or polyester, respectively. Tubular sleeve 16 would be formed about elastic resilient member 14 by either sewing or any other suitable means. Tubular sleeve may also be formed with a frill or fringe about its circumference for decorative purposes.

The second member of the braiding apparatus 10 is a similar lower tie 18 having an elastic resilient fabric or band 20 encapsulated in a tubular sleeve 22 of material similar to that of top tie 12. Lower tie 18 is generally circular in nature and in the preferred embodiment, the circumference of lower tie 18 is generally less than that of upper tie 12. Upper tie 12 and lower tie 18 are interconnected and secured together by a flexible length of fabric member 24 which is preferably secured to tubular sleeves 16 and 22 by a suitable means, such as sewing, or in the alternative, flexible linear member 24 may be secured directly to elastic resilient members 14 and 20 before their respective tubular sleeves are affixed about the elastic resilient members 14 and 20, respectively.

FIG. 2 is a partial perspective view illustrating elastic resilient member 14 within tubular sleeve 16 with tubular sleeve 16 secured by a sewing stitch 17. FIG. 3 illustrates the crimping of tubular sleeve 16 about elastic resilient member 14. The same effect would occur with elastic member 20 and tubular sleeve 22.

In this configuration, upper tie 12 is designed to allow a length of hair to pass through opening 26, such that upper tie 12 would be positioned proximate to the individual or user's head. Flexible linear member 24 and lower tie 18 would hang down from upper tie 12 and would be approximating the length of the section of hair which would pass through opening 26 of upper tie 12.

The braiding apparatus would be sized accordingly, such that the individual could purchase a braiding apparatus having a length which approximated the braiding length of the individual user's hair. As an example, a length of flexible member 24 of 5 inches, could be designated as a short size and be used with hair which was approximately 5 to 7 inches long. A length of 10 inches of resilient member 24 could be designated a medium size for use with hair 10 to 12 inches long. A length of resilient member 24 of 15 inches could be designated as a long length for use with hair 15 to 17 inches long. A length of 20 inches of resilient member 24 could be designated extra long for use with hair 20 to 22 inches long and a length of flexible resilient member 24 in a length of 25 inches could be designated extra, extra long for use with hair 25 to 27 inches long. The length of flexible member 24 could be varied without varying from the spirit and scope of the invention.

Figure 4:
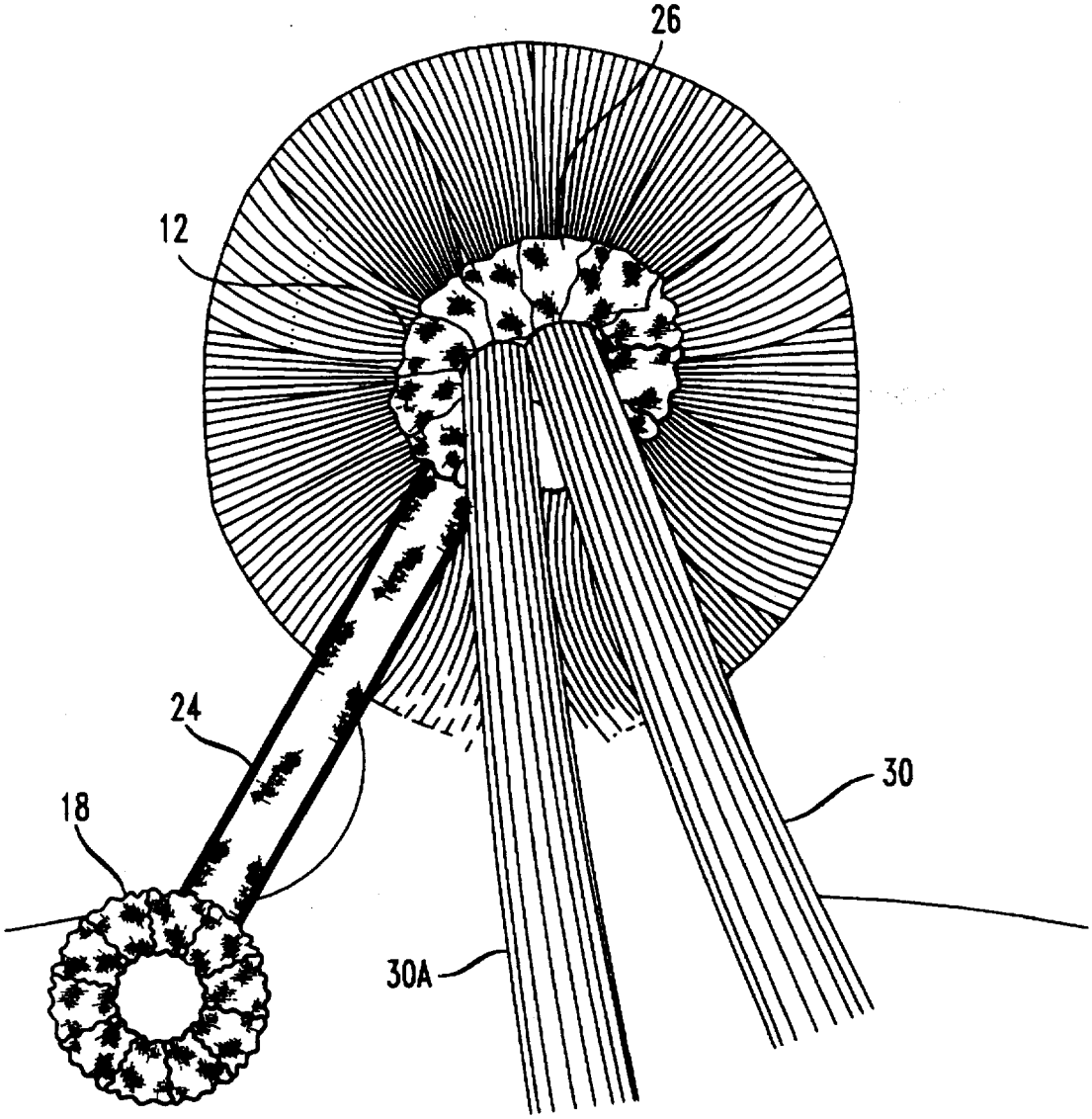
FIG. 4 is a rear perspective view of the initiation of the braiding method.
Figure 5:
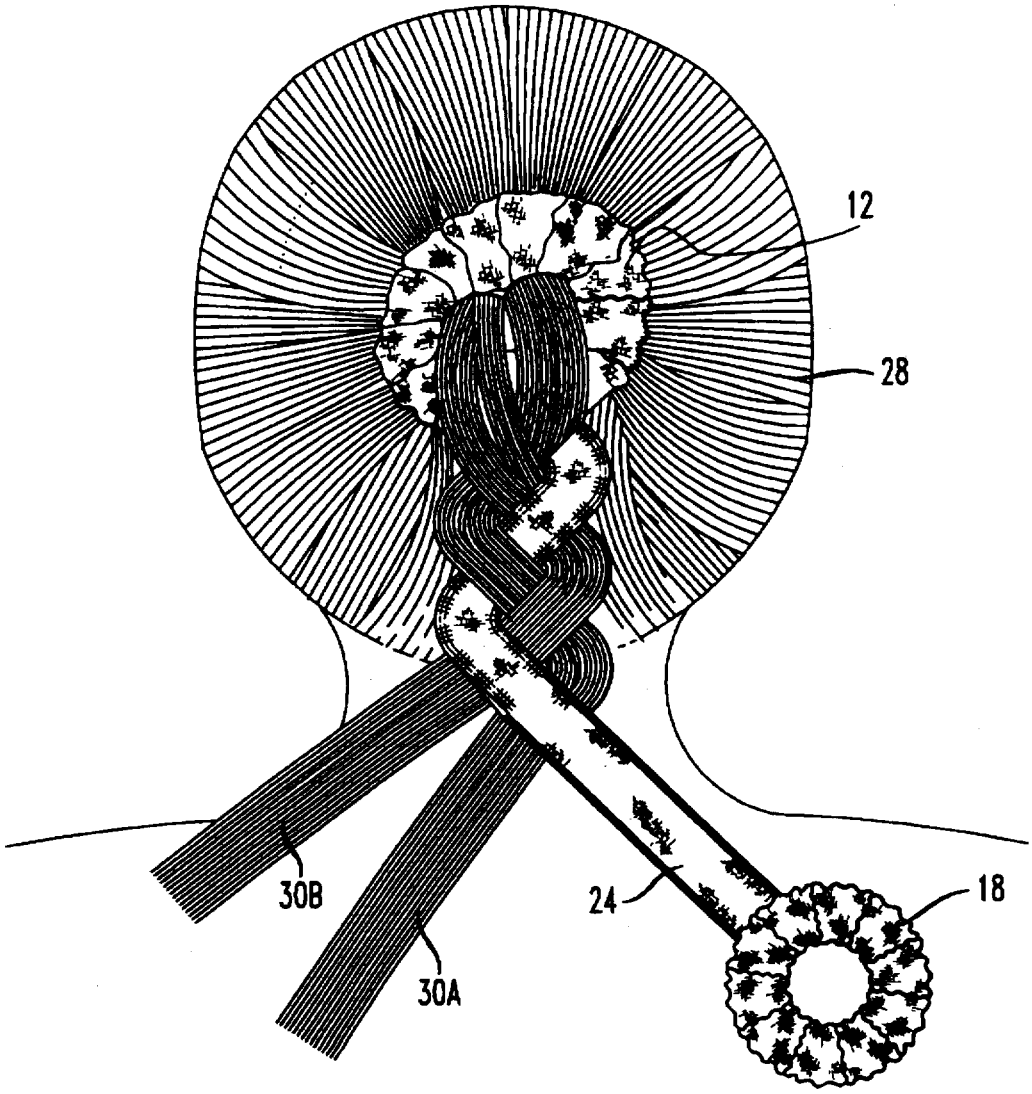
FIG. 5 is a rear perspective view of the intermediate steps of the braiding method.
Figure 6:
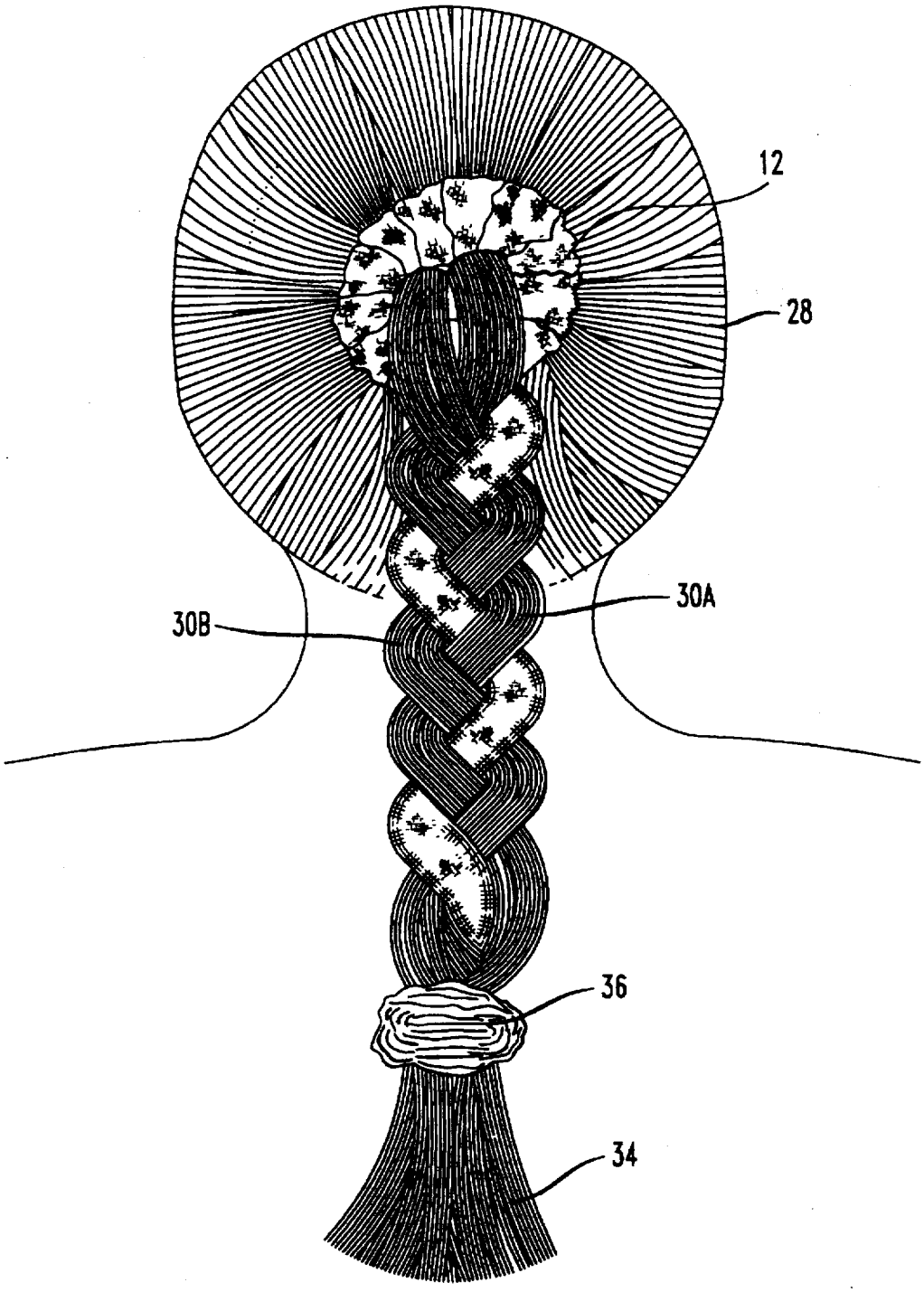
FIG. 6 is a rear perspective view of the completion of the braiding method.

FIGS. 4, 5 and 6 show the use of braiding apparatus 10 with respect to the individual user's hair. As stated, upper tie 12 would be positioned such that a length of hair would be drawn through aperture 26 and upper tie 12 would be positioned proximate the skull 28 of the individual. Upper tie 12 could be doubled or tripled about the hair to ensure a snug fit. The hair 30 would then be separated into two strands 30A and 30B. The flexible resilient member 24 and lower tie 18 would comprise the equivalent third strand of hair and would be positioned as a substitute for one of the three sections of the hair needed to make a braid.

The individual would then commence to braid the two strands or sections of hair 30A and 30B with flexible member 24 of braiding apparatus 10. This would be accomplished in the normal overlapping of the two strands of hair 30A and 30B and flexible member 24 until the individual had braided the hair sections and flexible member 24 to the proximate end 34 of the hair sections. The lower end of the hair sections 34 would then be inserted through aperture 27 formed in lower tie 18 and lower tie 18 could either singly or in double or tripled over fashion be used secure the lower end of the braid 36.

While the preferred embodiment illustrated shows upper tie 12 to be larger than lower tie 13, the two may be equal and while FIGS. 4, 5 and 6 illustrate the brading apparatus as substituting for an outside strand of hair, it could also substitute for the middle strand.

In this simple and economical means, the individual user is aided in forming the braid and maintaining the braid in a secure manner and is also allowed to introduce a decorative aspect to the braid since the tubular sleeve 16 and 22 as well as the interconnecting flexible member 24 would be made of a natural or man-made cloth material which would be dyed to a particular color or may incorporate a colored pattern. In addition, the fringe or frill which might extend about the circumference of upper tie 12 and lower tie 18 would also add a decorative aspect to the braiding apparatus. Therefore, the individual user would have the ability and option to have a variety of the aforesaid braiding apparatus to accommodate different lengths of hair depending upon the style in which the individual user wore his or her hair, and would also have the option and availability of a plurality of different braiding apparatus which could be color coordinated with other clothing which the individual or user might wear.

While the present invention has been described in connection with the exemplary embodiment thereof, it will be understood that many modifications will be apparent to those of ordinary skill in the art and that this application is intended to cover adaptations or variations thereof. Therefore, it is manifestly intended that the invention be only limited by the claims and the equivalents thereof.

What is claimed is:

1. A method for braiding hair comprising the steps of:

selecting a braiding aid having an elongate linear flexible cloth member having a first end and a second end, said first end of said elongate linear flexible body member having a first tie comprising an elastic flexible resilient member disposed within a tubular cloth sleeve member so as to form a loop, said elongate linear flexible member having a second tie secured to said second end of said elongate member, said second tie having an elastic, flexible, resilient member disposed within a tubular cloth sleeve member to form a loop;

expanding said first tie member of said braiding aid;

passing all hair to be braided through said first tie;

separating hair to be braided into two strands;

interweaving said two strands of hair with said elongate linear flexible cloth member to form a braid;

securing the end of said braid with said second tie by passing the end of said braid through an aperture formed in said second tie and overlapping said second tie to form a closure.

2. An apparatus for maintaining hair in a braid comprising:

an elongate linear flexible cloth body member having a first end and a second end;

a first tie member secured to said first end of said elongate linear body member, said first tie member comprising a resilient elastic member disposed within a tubular sleeve cloth member so as to form a loop;

a second tie member secured to said second end of said elongate linear body member, said second tie member having a resilient elastic member disposed within a tubular sleeve member so as to form a loop, said first tie member and said second tie member defining apertures therethrough for receipt of hair;

said aperture in said first tie member dimensioned to receive therethrough all of said hair to be braided, said aperture in said second tie member being positionable proximate to the end of said braid for securing the said end of said braid, wherein said elongate linear body member cooperates with said hair passing through said first tie member, said hair being divisible into two strands for interweaving in overlapping relationship with said elongate linear body member to form said braid.

* * * * *